US009844274B2

(12) United States Patent
Goldsmith

(10) Patent No.: US 9,844,274 B2
(45) **Date of Patent: *Dec. 19, 2017**

(54) MODULAR USER-ASSEMBLED ADJUSTABLE, AND HIGH-LOW ADJUSTABLE BEDS

(71) Applicant: Aaron Goldsmith, Postville, IA (US)

(72) Inventor: Aaron Goldsmith, Postville, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/630,257

(22) Filed: Jun. 22, 2017

(65) Prior Publication Data

US 2017/0280880 A1 Oct. 5, 2017

Related U.S. Application Data

(60) Continuation of application No. 15/204,600, filed on Jul. 7, 2016, now Pat. No. 9,713,388, which is a continuation-in-part of application No. 14/928,618, filed on Oct. 30, 2015, which is a continuation of application No. 14/525,989, filed on Oct. 28, 2014, now Pat. No. 9,198,520, which is a division of application No. 12/381,444, filed on Mar. 11, 2009, now abandoned.

(51) Int. Cl.

| | |
|---|---|
| ***A47C 19/02*** | (2006.01) |
| ***A47C 19/00*** | (2006.01) |
| ***A47C 20/04*** | (2006.01) |

(52) U.S. Cl.

CPC ..... *A47C 19/005* (2013.01); *A47C 19/025* (2013.01); *A47C 20/041* (2013.01); *Y10T 29/49826* (2015.01)

(58) Field of Classification Search

CPC ..... A47C 19/00; A47C 19/005; A47C 19/02; A47C 19/021; A47C 19/025; A47C 19/04; A61G 1/00; A61G 1/013; A61G 7/002; A61G 7/015; A61G 13/08

USPC ..... 5/184, 200.1, 201, 202, 282.1, 285, 286, 5/600, 613, 616–618, 620, 625, 627

See application file for complete search history.

(56) References Cited

U.S. PATENT DOCUMENTS

| | | | |
|---|---|---|---|
| 272,077 | A | 2/1883 | Mueller |
| 1,378,293 | A | 5/1921 | Stalder |
| 3,336,060 | A | 8/1967 | Bradford |
| 3,426,367 | A | 2/1969 | Bradford |
| 3,772,010 | A | 11/1973 | Weiss |

(Continued)

FOREIGN PATENT DOCUMENTS

WO WO2008010207 A1 1/2008

*Primary Examiner* — Robert G Santos

(74) *Attorney, Agent, or Firm* — Shuttleworth & Ingersoll, PLC; Jason Sytsma

(57) ABSTRACT

A frame for an adjustable has a head section with two longitudinal frame rails separated by at least two lateral members extending between the two longitudinal frame rails, and two sleeves each having a cavity with one of the two sleeves on each of the two longitudinal frame rails. The frame has a foot section having two longitudinal frame rails separated by at least two lateral members extending between the two longitudinal frame rails, and two sleeves each having a cavity with one of the two sleeves on each of the two longitudinal frame rails, and an inner tube with a nose for each of the two sleeves and for moving between a first position retracted in the cavity of the sleeve and a second position extending from the cavity of the sleeve.

10 Claims, 4 Drawing Sheets

(56) References Cited

U.S. PATENT DOCUMENTS

| | | | |
|---|---|---|---|
| 3,797,051 | A | 3/1974 | Evans |
| 3,886,606 | A | 6/1975 | Bradford |
| 3,958,283 | A | 5/1976 | Adams et al. |
| 4,025,972 | A | 5/1977 | Adams et al. |
| 4,114,209 | A | 9/1978 | Sandlin |
| 4,385,410 | A | 5/1983 | Elliott et al. |
| 4,594,743 | A | 6/1986 | Owen et al. |
| 4,712,837 | A | 12/1987 | Swilley |
| 4,901,383 | A | 2/1990 | Yang et al. |
| 5,063,623 | A | 11/1991 | Bathrick et al. |
| 5,148,562 | A | 9/1992 | Borders et al. |
| 5,425,150 | A | 6/1995 | Palmer, Jr. et al. |
| 5,568,661 | A | 10/1996 | Bathrick et al. |
| 5,605,378 | A | 2/1997 | Oyediran |
| 5,870,784 | A | 2/1999 | Elliott |
| 5,992,938 | A | 11/1999 | Jones |
| 6,109,695 | A | 8/2000 | Kahwaji |
| 6,276,011 | B1 | 8/2001 | Antinori |
| 6,357,065 | B1 | 3/2002 | Adams |
| 6,907,632 | B2 | 6/2005 | Bourgraf, Jr. |
| 6,990,698 | B2 | 1/2006 | Wall, Sr. |
| 8,104,124 | B2 | 1/2012 | Awerbuch et al. |
| 8,327,482 | B2 | 12/2012 | Awerbuch et al. |
| 9,198,520 | B2 | 12/2015 | Goldsmith |
| 9,713,388 | B2 * | 7/2017 | Goldsmith ..... A47C 19/005 |
| 2004/0010852 | A1 | 1/2004 | Bourgraf, Jr. |
| 2005/0251917 | A1 | 11/2005 | Wall |
| 2007/0044235 | A1 | 3/2007 | Navarro et al. |
| 2009/0000035 | A1 | 1/2009 | Awerbuch et al. |
| 2010/0154118 | A1 | 6/2010 | Pearce |
| 2010/0229303 | A1 | 9/2010 | Goldsmith |
| 2012/0030875 | A1 | 2/2012 | Barthelt |
| 2012/0102651 | A1 | 5/2012 | Awerbuch et al. |
| 2015/0040313 | A1 | 2/2015 | Goldsmith |
| 2015/0250323 | A1 | 9/2015 | Goldsmith |
| 2016/0051058 | A1 | 2/2016 | Goldsmith |
| 2016/0316919 | A1 | 11/2016 | Goldsmith |

* cited by examiner

MODULAR USER-ASSEMBLED ADJUSTABLE, AND HIGH-LOW ADJUSTABLE BEDS

This application is a continuation of U.S. patent application Ser. No. 15/204,600 filed Jul. 7, 2016 which is a continuation-in-part of U.S. patent application Ser. No. 14/928,618 filed Oct. 30, 2015, which is a continuation of U.S. patent application Ser. No. 14/525,989 filed on Oct. 28, 2014 (and granted as U.S. Pat. No. 9,198,520), which is a division of Ser. No. 12/381,444 filed Mar. 11, 2009 (and now abandoned), the entirety of which all are incorporated by reference herein.

BACKGROUND OF THE INVENTION

The present invention generally concerns adjustable beds where the contour of the upper surface of the bed is adjustable, and high-low adjustable beds that are adjustable in elevation above a floor as well as in contour.

The present invention particularly concerns adjustable, and high-low adjustable, beds that sell, ship, and assemble as modules.

As reported in the entry "Adjustable bed" appearing in Wikipedia, the free encyclopedia of the Internet circa 2008, "[a]n adjustable bed is a bed which has a multi-hinged lying surface which can be profiled to a number of different positions. Common adjustment includes inclining the upper body and raising the lower body independently of each other. Other common features include height adjustment and tilting the bed to raise the upper body or the lower body into the Anti-Trendelenburg/Trendelenburg positions.

"Adjustable beds have been used in hospitals for a long time, but have become more commonly used in home care over the past three decades, as they have been found to provide relief from various conditions. Adjustable beds used in hospitals and home care are similar in basic functionality, however hospital beds must be able to withstand more rigorous and regular cleaning in order to reduce contamination and therefore any electrical bed components used in the hospital environment need to meet minimum waterproofing standards in order to withstand the cleaning process. Home care beds are less likely to be subjected to such intense cleaning, even if used within a care home, and this allows manufacturers to design beds whose aesthetics match home furnishings by using divan style beds or by using wooden veneer and laminates . . . .

"The increased popularity of motorized adjustable beds for home care is also partly due to the benefits provided to the care giver, by allowing them to work at a comfortable height and reduce the risk of back injuries. Height adjustment and raising the upper body also assists users in getting out of bed with little or no assistance dependent on their condition."

In the Trendelenburg position the head is lower than the feet. In the anti-Trendelenburg position the feet are lower than the head. The head of a bed may be adjustable under force of a motor, and the base also, normally by a separate motor. A bed that may be elevated or depressed simultaneously in both its head and foot regions is called a "high-low bed" or, when adjustable, a "high-low adjustable bed", or, when fully motorized with up to four motors, "a motorized high-low adjustable bed".

Many beds, and motorized beds, and adjustable beds, and motorized adjustable beds, exist to realize these Trendelenburg and anti-Trendelenburg positions, which are variously useful in therapies for various afflictions. Specific beds are reviewed not for being of particular pertinence to the modular assemblable bed of the present invention but only so that it may be seen from these references that a fully motorized high-low adjustable bed is not a trivial example of mechanical engineering but is, indeed, a highly evolved and highly efficient and effective design.

U.S. Pat. No. 5,148,562 for a Birthing bed adjustable to Trendelenburg position concerns a birthing bed has a base, an intermediate frame mounted on the base with a power-actuated linkage to raise and lower the intermediate frame with respect to the base. A main frame is pivotally mounted on the intermediate frame so that it can be shifted from a horizontal position to an inclined Trendelenburg position. The intermediate frame is adapted to be lowered to bring the patient support surface to a very low level. In that level, the bed can be shifted to a Trendelenburg position with limit switches causing the intermediate frame to rise in order to accommodate the shift of the main frame to the inclined Trendelenburg position.

U.S. Pat. No. 3,722,010 for an ADJUSTABLE HOSPITAL BED INSTANTLY MOVABLE TO A TRENDELENBURG POSITION concerns a hospital bed having articulated head and foot elevation linkage systems that effect vertical movement of an upper horizontal frame, to which a mattress supporting structure is attached, with respect to a fixed lower horizontal frame. Rapid shifting to a trendelenburg position is achieved by providing, in the foot linkage system, an extendible segment having a pair of elongated links one of which is slidably and rectilinearly movable in the other. The segment maybe quickly extended and locked, and by so doing the upper frame becomes tilted at a desired trendelenburg angle with its foot end raised relative to its head end.

U.S. Pat. No. 4,025,972 for an Elevating and Trendelenburg mechanism for an adjustable bed concerns an improved control and locking device for a hospital bed such as that disclosed in U.S. patent application Ser. No. 496,212, used to provide a positive lock of the hospital bed in a Trendelenburg or reverse Trendelenburg position and eliminate the capability to manually or inadvertently remove the bed from such position. As depicted herein, the locking device is a pivotal abutment which normally precludes release of a hook holding the bed in a Trendelenburg position. Yet, when the entire bed is raised by its electric motor, the abutment is automatically withdrawn from its abutting, locking position to permit the bed to lower under electric power.

U.S. Pat. No. 3,958,283 for an Elevating and Trendelenburg mechanism for an adjustable bed concerns an elevating and Trendelenburg mechanism for a hospital bed providing elevated Trendelenburg positions and positive latching of cooperating members. Two torque tubes pivotally attach to an elevating frame. Lift arms welded to the torque tubes support the frame at various elevations. A motor on the frame produces rotation of a yoke pivotally attached to one of the torque tubes. The yoke abuts a first drive arm rigidly attached to the tube to lift one end of the frame, and a second drive arm pivotally attached to the tube. A rod connects the second drive arm to a pivot plate as a second rod connects the pivot plate to a third drive arm welded to the other torque tube to lift the other end of the bed. When the frame raises to about its maximum height, one of two hooks on the frame may prevent the first or second drive arm from following a receding yoke, with the result that one end of the bed remains elevated while the other lowers. When not so engaged with the hooks, the second and third drive arms latch onto the yoke to prevent externally produced relative motion of the components.

Examples of ready-to-assemble or take-apart furniture is disclosed in U.S. Pat. No. 4,712,837 (Swilley); U.S. Pat. No. 5,605,378 (Oyediran); U.S. Pat. No. 5,992,938 (Jones); and U.S. Pat. No. 6,109,695 (Kahwaji).

U.S. Pat. No. 4,712,837 discloses a portable multipurpose chair that can be easily assembled and disassembled for transport storage and use. The chair components include right and left hand leg members, a seat member, a back member, an arm member having right and left hand arm portions joined by an interconnecting section, and a support member. The main components are planar and configured as an equilateral triangle or are based on an equilateral triangle. The components are formed with slots to interlock and connect one component to another. A back support includes dowel holes for a seat support and the sides include dowel holes at their apex for facilitating assembly. U.S. Pat. No. 5,605,378 discloses a "take-apart chair" comprising a seat, a pair of side pieces each having a back and seat support portion, a backrest and a brace member. The aforementioned pieces comprise hooks and notches designed for fixing them to each other in order to assemble the chair.

U.S. Pat. No. 5,992,938 describes items of furniture having interlocking parts formed of basic geometric shapes. In one embodiment a chair is formed of a circular back-support part, a triangular seat and square legs arranged parallel to each other. The parts are slotted to receive slots of equal depth formed in mating parts so that the assembled furniture item is strong and stable. The furniture is particularly intended to have aesthetic appeal and teach children about basic shapes, the art of design, and the art of construction.

U.S. Pat. No. 6,109,695 shows a chair assembly having detachably fitting parts. Vertically arranged right and left hand side chair supports include slots extending from the exterior profile of the first side support towards the center of the side support. A seat pan having extensions fits into two complementary slots of the right and left side supports. A back support having extensions also fits into two complementary slots of the right and left side supports. The seat pan and the back support may be independently adjusted so as to present various sitting positions.

International Application No. PCT/IL2007/000879 for ASSEMBLABLE FURNITURE relates to furniture intended for different uses such as a chair, an arm chair, a bed, an open cupboard, a stand, love-seat, sofa and the like. The structure shown and described is quite unlike the steel bed frame of the present invention, but similar requirements of strength, non-flexibility, safety and the like may be noted to be in common with the present invention. In the PCT application assemble-able furniture comprises a base (11) and a left side support part (14), a right side support part (15), a back part (12) and a front support part (13), each of said parts (12-15), not including the base (11), having a thickness and comprising two slots, said left side support part (14) and said right side support part (15) each comprising a front slot (50a; 50b) and a rear slot (40a;40b), and said back part (12) and front support part (13) each comprising a right slot (30b;60a) and a left slot (30a,-60b), each slot disposed and dimensioned to correspond to and fit with another slot and a portion of a corresponding part, each slot having a width being slightly greater than the thickness of the portion of the part to which it corresponds upon assembly, wherein when the furniture is assembled, said parts mutually inter-fit at said slots to form a rectangular frame within which said base (11) rests; and said slots flare out at an angle such that said parts upwardly flare out when the furniture is assembled.

Most recently, United States Patent Application publication number 20070044235 for an Easily Assembled Bed Frame concerns a bed frame that can be assembled without the use of additional tools. The bed frame generally comprises a pair of spaced side rails, retainer brackets secured to each side rail, and cross support members extending between the side rails. Each retainer bracket has a base section for supporting one of the cross support members and an aperture extending through the base section. The apertures are aligned with threaded bores in the cross support members so that threaded portions of respective leg assemblies may be inserted through the apertures and used to secure the cross support members to the corresponding retainer brackets.

The "Minnen" extendable children's bed with iron bars of the IKEA company has proven to be a popular, but troubled, consumer product, namely, the bed was pulled from the UK market after it was involved in the death of a 21-month-old girl. The children's bed involved was made on Aug. 24, 2008, Swedish furniture giant IKEA. A Nottinghamshire child strangled to death as she tried to retrieve a doll from the bed after waking from a nap, her head caught between the bed's iron bars, newspaper the Daily Mirror reports.

IKEA stopped the sale of the bed, named "Minnen" pending police investigation of the accident in Great Britain, but the model continued on sale in Scandinavia. IKEA Norway found no reason to believe there was a direct connection between the bed and the tragic accident in England, and the "Minnen" bed remained on sale In Norway.

IKEA has sold 58,000 "Minnen" beds around the world since their introduction in March 2005.

U.S. Pat. No. 6,990,698 to Wall, Sr. for a UPS shippable adjustable articulating bed concerns an adjustable articulated bed with separate adjustable leg and head/back assemblies which support an articulating mattress. The bed is manufactured in three pieces specifically designed for economical shipping directly to consumers via United Parcel, FedEx or US Postal, and is easily assembled without tools. The appearance of the bed is similar to that of a standard bed box spring, or platform foundation and may be assembled and placed on a traditional metal frame, headboard, or footboard with side rails. Optional adjustable height legs are threadably attachable into support brackets connected to the bottom of each assembly to adjust the overall height of the bed. The three sections include a head support assembly with lifting arms pivotally attached to a head lifting frame and a deck panel attached thereatop to elevate the head and upper body; a leg support assembly with lifting arms pivotally attached to a two-part leg lifting frame with deck panels attached thereatop to elevate the legs; and a stationary center section supports the middle or buttocks area of the user. When the motor is attached between the leg and head support assemblies locking the assemblies together, the center section then slides into place there between. No tools, pins, clips or snaps are required for assembly.

Mentioned in the Background of the Invention section of this '698 patent are eight earlier U.S. patents. Those patents of some four inventors that appear to be most pertinent to the present invention seem to be.

U.S. Pat. No. 4,385,410 to Elliott, et al., disclose an articulated adjustable bed with a single motor which raises the first adjustable section and, through the linkage, the second adjustable section. Another adjustable articulated bed is disclosed by the same inventor in U.S. Pat. No. 5,870,784. Bathrick, et al., disclose articulated beds in U.S. Pat. Nos. 5,063,623 and 5,568,661. U.S. Pat. No. 5,063,623 is directed to a power module for an articulated bed and the '661 patent is directed to an articulated bed with a modified standard frame supporting an independent power module. Palmer, Jr., et al., in U.S. Pat. No. 5,425,150, teach a device for converting a flat bed into an adjustable bed utilizing an articulating platform sandwiched between the box springs and the mattress.

And, finally, in U.S. Pat. No. 6,276,011 Antinori teaches an adjustable bed with a first frame and a second slide frame connected thereon. Although the goals of the present invention and the prior art particularly including the '698 patent are similar, the '698 patent, in particular and despite its Florida~ based inventor, describes a system for an adjustable bed that is widely used in Europe. Although economical of construction, this system has, alas, proven to be flimsy and manifestly unsuitable for the larger people of the United States. Worse, the method and means of attaching the sections of the UPS SHIPPABLE ADJUSTABLE ARTICULATING BED of the '698 patent is neither particularly strong, nor rigid, and entire adjustable bed is rendered unstable by potential excessive motion, and even disconnection resulting from mechanical failure, between the preferred three sections of the adjustable bed.

The present invention will be seen to teach a system for connecting modular sections of an adjustable bed which system is very strong, and rigid, nonetheless to being assembled without tools, and particularly without such tools as might provide compressive connection, such as with and by the tightening of nuts and bolts.

As explained in U.S. Pat. No. 6,990,698 to Wall, Sr. for a UPS shippable adjustable articulating bed, "Adjustable beds for comfort and therapy are extremely well known and provide support surfaces for a mattress which will incline the back/head of a user to any desired angle and will also separately incline the legs of the user for both comfort and therapeutic purposes. However, these articulated beds include mattress support or deck structure and motor driven power units which, in their assembled form, are extremely heavy and exceed all conventional economical shipping means available and therefore fall into categories of freight shipping costs which are substantially higher in shipping rates.

"The substantially higher . . . [f]reight charges can exceed $150 [circa 2006] and delivery and assembly costs for each adjustable twin bed, for example, weighing over 170 lbs. requires a two-man delivery team . . . . [Such additional costs can themselves approach the cost of a conventional bed frame, and exceed $300.00.]

"The popularity of adjustable beds increased when advertising programs became directed toward consumers with health or sleeping disorders or simply to recline while reading or watching television. Being manufactured primarily in conventional bedding sizes, the ease with which these inclining beds fitted into a bedroom situation [has] greatly increased usage.

"The construction of adjustable bed bases has changed very little over the past thirty years. Most adjustable bed bases are constructed with angle iron frames. A linear actuator lift motor is attached to pivotally connected lifting arms which independent raise and lower the head/back portion and segmented leg portions; typically moving about a stationary transverse mid torso or buttocks support area. A plywood or particle board deck with upholstered padding is attached to the lifting arms and decorative wood or laminate panels are applied to the sides of the exposed metal frame for a finished appearance . . . ."

SUMMARY OF THE INVENTION

The present invention has aspects of, and is embodied in, (1) an adjustable bed assembled from modular frame sections; (2) a structure, and a method, for attaching together plural sections of a modular adjustable bed so as to form an entire adjustable bed; (3) a user-assembled modular adjustable bed to which the user can selectively specify additional motors so as to realize the Trendelenburg position, the anti-Trendelenburg position, or the complete high-low elevation of the surface of the bed; and (4) a business method of shipping and delivering an adjustable bed to a user of the bed who subsequently erects the bed.

Particularly as regards the shipping and delivering of the bed, the bed may be sold as "cash and carry" merchandise, meaning that if may be purchased in boxes from a store normally exhibiting a floor model of the bed, loaded in the purchaser's vehicle, and hauled away without further any involvement of the seller. Moreover, if shipped, then the bed can be so shipped at minimum cost in boxes that fit upon standard pallets, including as may be delivered by standard parcel services to an end item purchaser-erector-user of the bed.

In one of its aspects the present invention is embodied in an adjustable bed—having juxtaposed between a mattress and a floor an articulated frame, and also one or more wired motors operating on the articulated frame so that the mattress resting atop the frame is adjusted in contour—where the articulated frame ships in two or more modular frame sections each of which sections can be assembled to the others.

Notably, this articulated frame ships in two or more modular frame sections each of which is sufficiently small so as to fit upon a standard shipping pallet of 48" by 48". The bed may be sold by a store to a purchaser while still upon these palettes which can be loaded to the purchaser's vehicle, or off-loaded from the palettes and loaded in sections onto the purchaser's vehicle. All sections are modular, and are generally subject to being manipulated both packaged and unpackaged by one single adult man.

Further notably, assembly is by a semi-permanent engagement between modular sections by action of by sliding a protrusion on one section into a cavity of a next section. This protrusion of the one section is preferably a tube that slides into a tubular cavity of the next section Assembly of this modular by the semipermanent engagement of its two or more frame sections can be realized by a single adult man.

The modular frame sections are preferably sufficiently small, at least in a twin . . . size version of the adjustable bed—base size approximately 39"×75"—so as to fit upon two standard shipping pallets each of 48" by 48". A full size version of the adjustable bed—base size approximately 54"×75"—fits upon two shipping pallets each of 55" by 48". Finally, a queen size version of the adjustable bed—base size approximately 60"×80"—fits upon two shipping pallets each of 60" by 48".

The modular frame sections are preferably two in number—called a "head section" and a "foot section". Each preferably contains a pre-wired motor respectively for adjusting the contours of the bed in its head and foot regions. Including the motor, each section is preferably sufficiently light, normally less than 120 pounds in the heaviest, or queen size version, so as to be within health and safety guidelines for safe manipulation by one adult man only.

The modular adjustable bed is preferably mechanically and electrically semi-permanently assembled from the two or more modular frame sections by the single adult man. This assembly is more preferably without use of tools. The preferred semi-permanent assembly of the two or more frame sections by the one adult man preferably initially proceeds from the bottom of these sections as they inverted upon the floor, with the motors and wiring therefor connected by electrical plug jacks, and with the inverted assembled sections assembled sections and wired motors being subsequently turned over and upright by tilting but one time only and always safely within the physical limits of the reference single man.

A third motor may optionally be added at the foot of the bed so as to realize the elevation thereof so as to make the surface of the bed assume the Trendelenburg position where the head of an occupant of the bed is lower than the feet of the occupant. Conversely this same third motor may optionally be added at the head of the bed so as to realize the elevation thereof so as to make the surface of the bed assume the anti-Trendelenburg position where the head of an occupant of the bed is lower than the feet of the occupant.

Finally, both a third, and a fourth, motor may optionally be added at both the foot, and the head, of the bed so as to, in combination, permit the bed to do any of (I) assume the Trendelenburg position where the head of an occupant of the bed is lower than the feet of the occupant, (2) assume the anti-Trendelenburg position where the occupant's feet are lower than the occupant's head, or (3) by operation of both motors so as to simultaneous elevate the surface of the bed in both its head and foot regions, realize a "high-low adjustable bed".

In another of its aspects the present invention regards a structure, and a method, for attaching plural sections of a modular adjustable bed so as to form an entire adjustable bed.

In a preferred embodiment an improvement is made to an adjustable bed having a frame with major, long, longitudinal frame members. The improvement partitions the major, long, longitudinal frame members of the bed's frame into two separable sections, each a substantial half. A first half frame section has with two spaced-parallel elongate tubes each of which defines and presents a longitudinal cavity at a one end which is disposed towards the other frame section second half frame likewise has two spaced-parallel elongate tubes each defines and presents a cavity already filled with an elongate inner tube that is complimentary in shape and in size to the longitudinal cavities of the first half frame. Each elongate inner tube extends from a one end of the second half frame so that this inner tube may be slid into a corresponding cavity of a juxtaposed elongate tube of the first half frame. By this sliding engagement the elongate inner tubes of the second half frame engage the hollow elongate tubes of the first half frame, and both frame halves are held locked together in rigid alignment.

The inner tube of each elongate tube of the second half frame is preferably floating. Each of the floating inner tubes of each elongate tube of the second half frame is m or preferably tipped with a plastic pilot plug so as to guide its insertion in the corresponding cavity of the juxtaposed elongate tube of the first half frame.

Both frame halves are preferably held locked together in their rigid alignment by a locking mechanism. This locking mechanism is preferably fitted to the inner tube of each elongate tube of the second half frame, and preferably consists of a bulbous-nose spring pin extending under spring force transversely to the inner tube in a region of the inner tube that is inserted into the corresponding cavity of the juxtaposed elongate tube of the first half frame. In combination with this structure each elongate tube of the first half frame presents and defines within its longitudinal cavity a hole that is complimentary in shape and in size to a tip of the spring pin this spring-loaded pin and hole operates so that when and only when the inner tube of each first second half frame is slid fully within a corresponding cavity of a juxtaposed elongate tube of the first half frame, then the spring pin will extend under spring force, locking the second half-frame inner tube within the elongate tube of the first half frame, and thus the first half frame to the second half frame.

Each of the elongate tubes of both the first half frame and the second half frame preferably consists of square cross-sectional steel tubing.

In yet another of its aspects the present invention is embodied in a user—assembled modular adjustable bed in which and to which—nonetheless to being both modular and user-assembled the user can selectively specify additional motors so as to realize any of the Trendelenburg position, the anti-Trendelenburg position, or a complete high-low elevation of the surface of the bed.

In one embodiment an adjustable bed—having juxtaposed between a mattress and a floor an articulated frame, and also one or more wired motors operating on the articulated frame so that the mattress resting atop the frame is adjusted in contour—that is modular, and where the articulated frame ships in two or more modular frame sections each of which sections can be assembled to the others by a single "reference-standard" adult man in order to form the articulated frame set upright.—hereinafter in this section called the "modular adjustable bed"—further includes a third motor added to the foot modular frame section, and at the foot of the bed so as to realize the elevation thereof. By this elevation the surface of the bed assumes the Trendelenburg position where the head of an occupant of the is lower than the feet of the occupant.

Alternatively, the modular adjustable bed may include a third motor added to the head modular frame section, and at the head of the bed so as to realize the elevation thereof. By this elevation the surface of the bed assumes the anti-Trendelenburg position where the head of an occupant of the bed is higher than the feet of the occupant.

Finally, and still further alternatively, both a third and a fourth motor may be added to the modular adjustable bed in both the foot, and the head, frame sections thereof, these motors serve to, respectively, elevate the foot portion, and the head portion, of the surface of the bed. These selective motorized elevations, in combination, permit the bed to do any of (I) assume the Trendelenburg position where the head of an occupant of the bed is lower than the feet of the occupant, (2) assume the anti-Trendelenburg position where the occupant's feet are lower than the occupant's head, or (3) by operation of both motors so as to simultaneous elevate the surface of the bed in both its head and foot regions.

In still yet another of its aspects the present invention is embodied in a business method of delivering and erecting a home-use adjustable bed to a user of the bed. In a preferred from the method includes providing to the user by loading into the user's vehicle at a store, or by shipment to the user, or by both loading and shipment, each of at least (1) a first frame section, (2) a second frame section; and then erecting the adjustable bed transpires with and by one single adult man in steps of assembling the first frame section to the second frame section.

Each of the (1) first frame section, and the (2) second frame section, preferably includes at least one motor and associated wiring and controls. Both sections together normally include printed directions for assembly Each section of preferably are of size and weight as permits safely movement and manipulated by but one single adult man.

The erecting preferably transpires while each frame section sets inverted upon the floor, with the frame sections being mechanically connected while the one or more motors and associated wiring and controls are electrically connected. These steps also are preferably accomplishable by the one single adult man. Indeed, the one single adult man is normally the user, and the adjustable bed is thus user-assembled.

Still further, the user doing the erecting may preferably specify any of different numbers of motors, which are provided to him of her, so that a high-low adjustability of the bed, as well as a contour adjustability, may be to some degree selectively customized to and by the user.

These and other aspects and attributes of the present invention will become increasingly clear upon reference to the following drawings and accompanying specification.

DESCRIPTION OF THE PREFERRED EMBODIMENT

Figure 1:
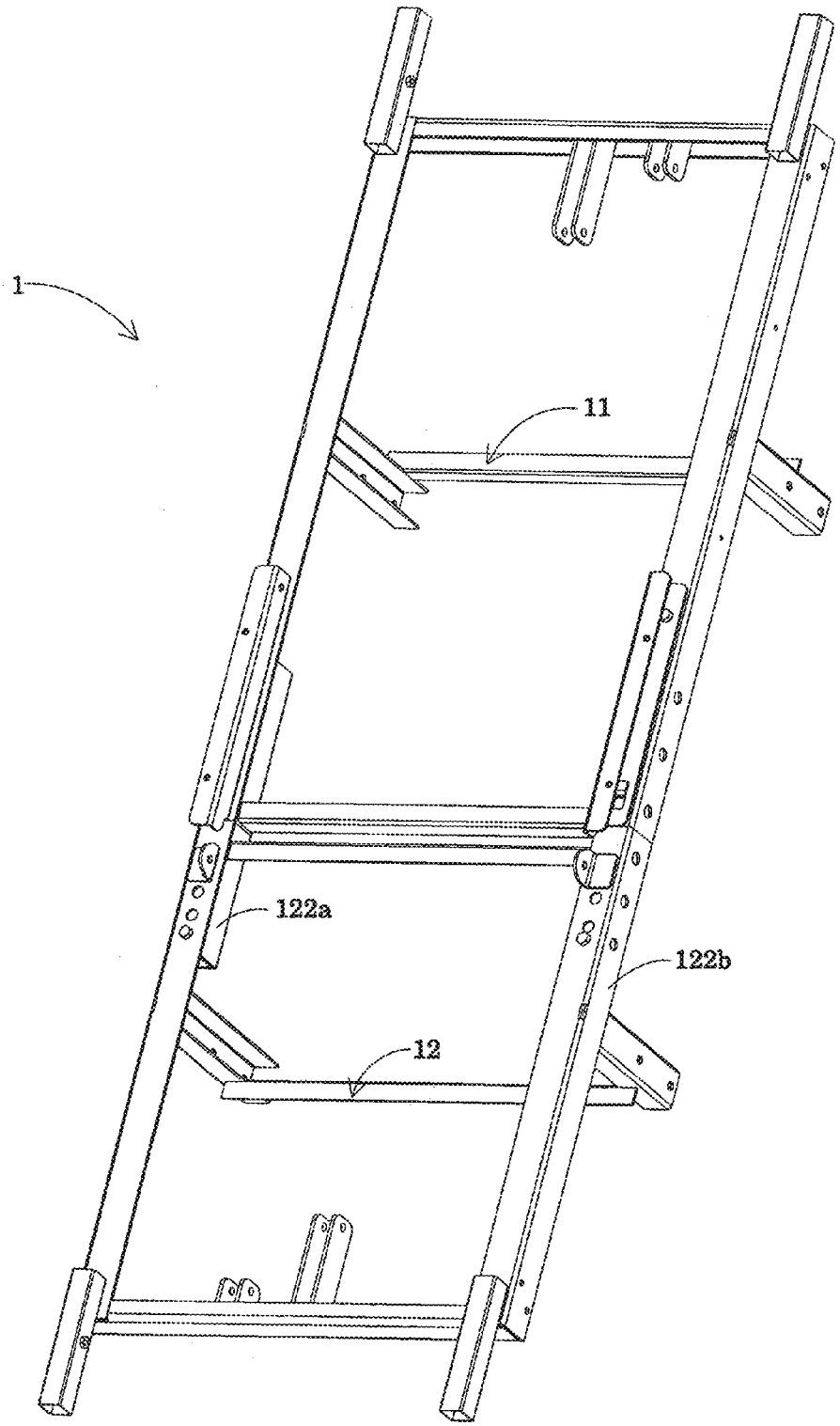
FIG. 1 is a diagrammatic perspective view of a base portion of a preferred 'embodiment of the modular adjustable bed of the present invention, the portion shown being without motors and wiring.
Figure 2:
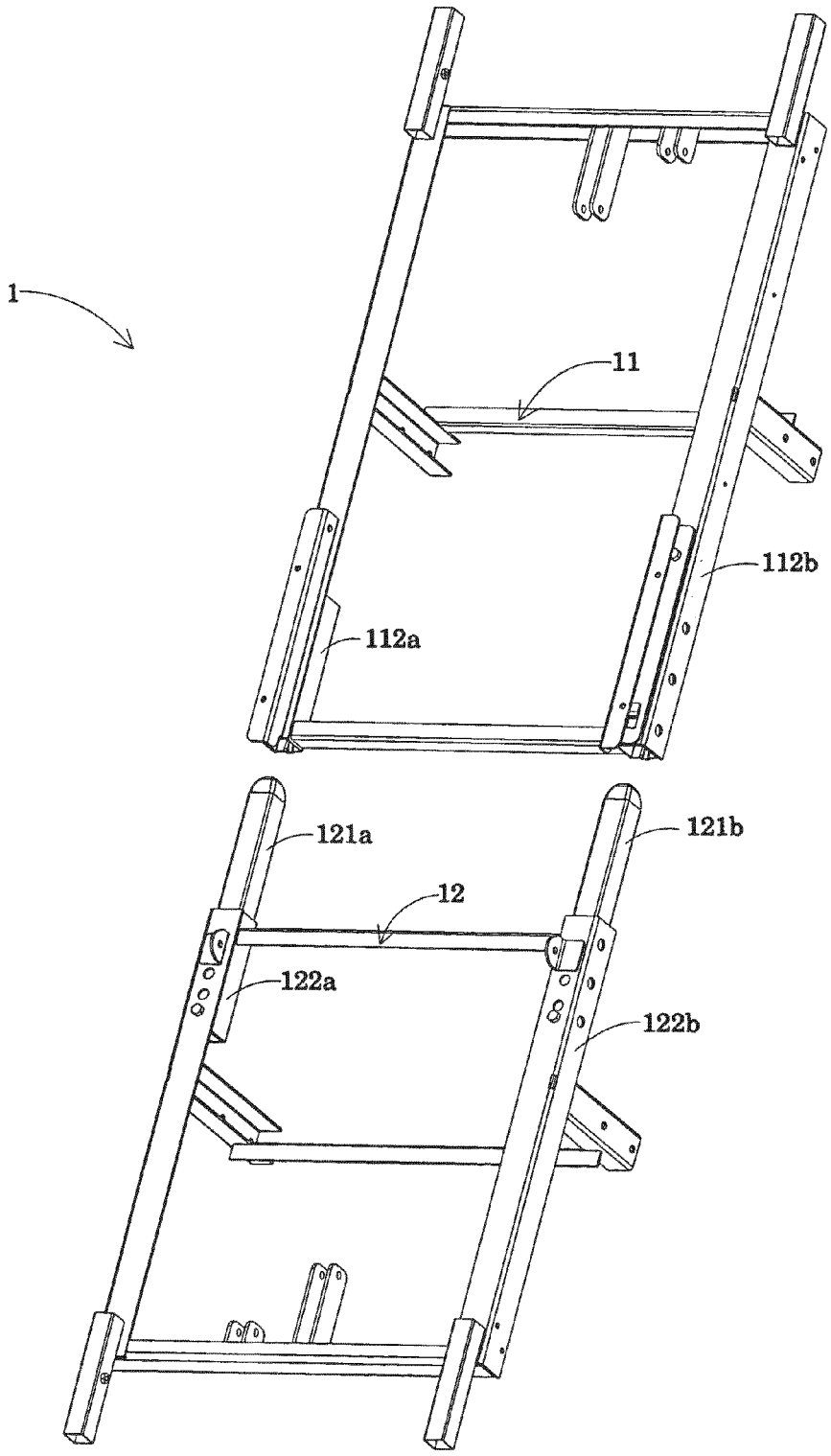
FIG. 2 is a diagrammatic perspective view of the base portion of the preferred embodiment of the modular adjustable bed of the present invention, previously seen in FIG. 1, now split into it head and foot sections that are each boxed and shipped separately, and later assembled together by a purchaser-user without use of tools.

A diagrammatic perspective view of base portion 1 of a preferred embodiment of a modular adjustable bed of the present invention, this base portion 1 being shown being without associated motors and wiring, is contained in FIG. 1. Another diagrammatic perspective view of this same portion 1, now split into a head section 11 and a foot section 12 (that are each boxed and shipped separately, and later assembled together by a purchaser-user without use of tools) is shown in FIG. 2. The portion 1 is substantially constructed of square cross section steel tube. Various attachment points are presented at which the pivoting bed surfaces, and the motors, of the adjustable bed may be conventionally attached.

In accordance with the present invention, two bull-nosed inner tubes 121*a*, 121*b* (best seen in FIG. 2) extend from spaced-parallel foot frame section 12 towards corresponding cavities in the complimentary spaced-parallel frame rails 112*a*, 112*b* of the head frame section 11. The protruding inner tubes 121*a*, 121*b* slide longitudinally into the opposed cavities of the head frame section frame rails 112*a*, 112*b*, semi-permanently joining the two, head and foot, frame sections 11, 12. The fit is snug, and the connection strong, but the union may readily be accomplished under force of the hands and arms of an adult man.

Figure 3A:
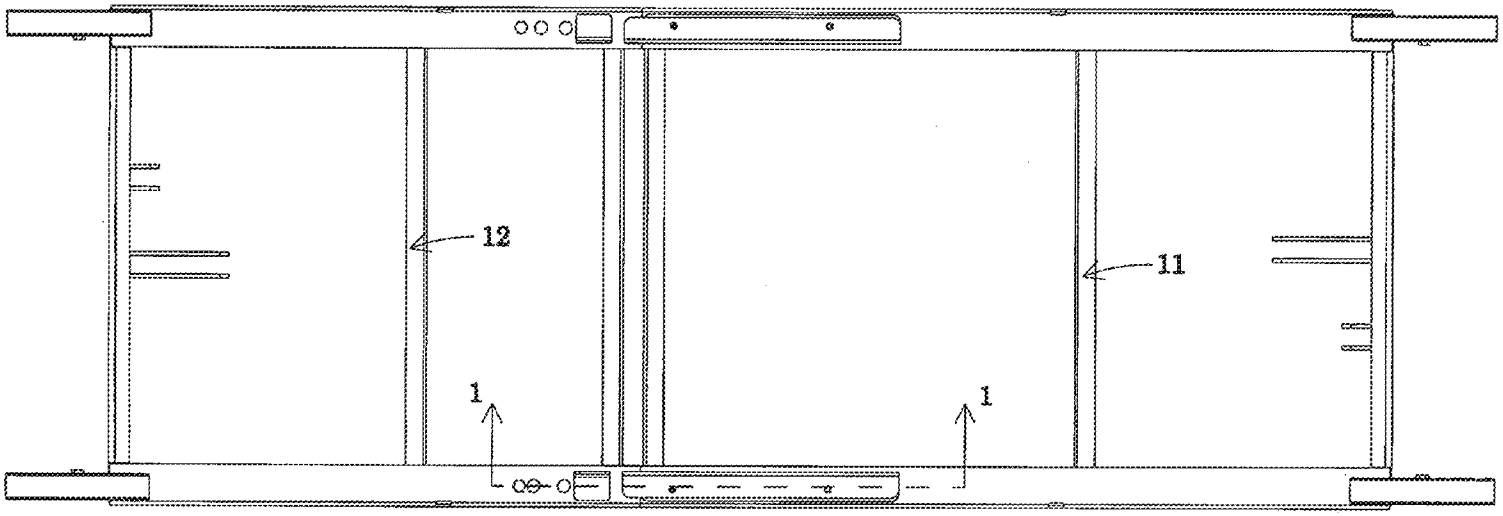
FIG. 3, consisting of FIG. 3*a* and FIG. 3*b*, are detailed plan views showing the telescoping attachment mechanism of the heat and foot sections of the partial preferred embodiment of the modular adjustable bed of the present invention, previously seen in FIGS. 1 and 2.
Figure 3B:
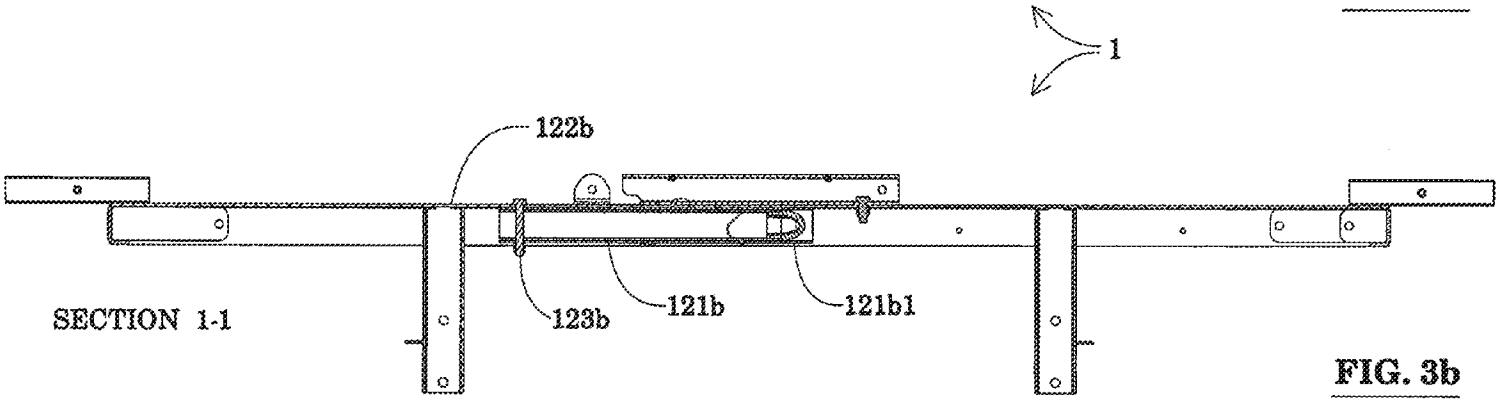

Detailed plan views showing the telescoping attachment mechanism of the head and foot sections 11, 12 of the partial preferred embodiment of the modular adjustable bed of the present invention are shown in FIGS. 3*a* and 3*b*. FIG. 3*b* is a cut-away cross sectional view taken along aspect line 1-1 of FIG. 3*a*.

A plastic nose—of which nose 121*b* of inner tube 121*b* is shown—on each of the inner tubes 121*a*, 121*b* serves to guide each tube into the cavity of head section frame rail tubes 112*a*, 112*b*. A bolt, of which bolt 123*b* shown in FIG. 3*b* is exemplary, may be dropped into holes that become aligned upon sliding connection of the frame rails, therein to strongly hold the sections together. All bolts may be removed from disassembly.

The head and foot sections 11, 12 of the base of the preferred embodiment of the modular adjustable bed of the present invention are the largest sections of the bed. Other parts and sections, such as the planar sections that comprise the sleeping surface of the bed, the motors for the bed and their wiring harness, and the controls for the bed, are all smaller, and lighter, than are the head and foot sections 11, 12. Moreover, it is the interlocking between the head section 11 and the foot section 12 that, in particular, provides strength, stability, and durability to the adjustable bed. Accordingly, the gravamen of the present invention will be found within the quality affixation and union, achieved without tools, of the head and foot sections 11, 12, and it will be understood that beds and adjustable beds of standard design may readily be affixed to the illustrated modular base by practitioners of the design of mechanical beds.

Figure 4B:
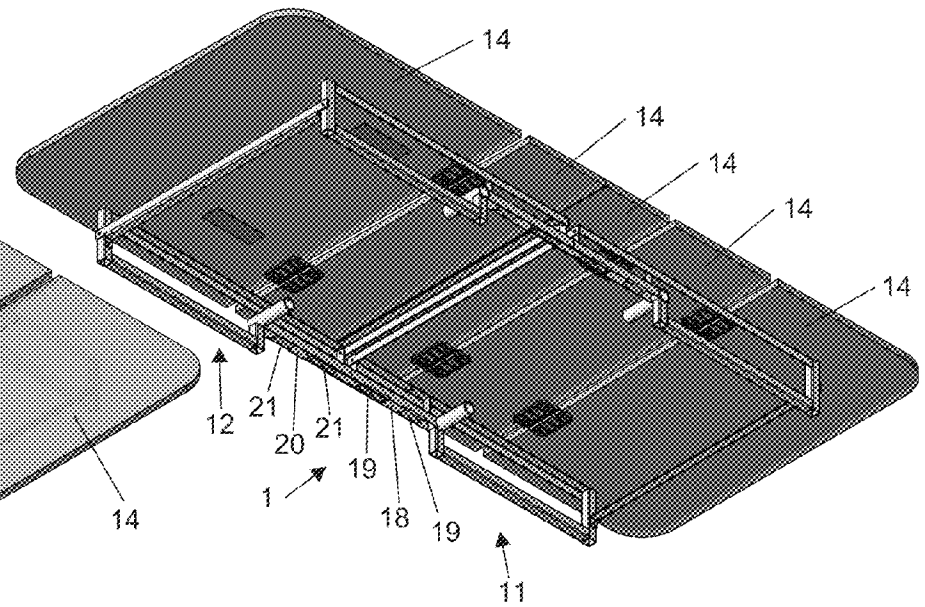
FIG. 4*b* is an isomeric bottom view of the bed of FIG. 4*b*.
Figure 4A:
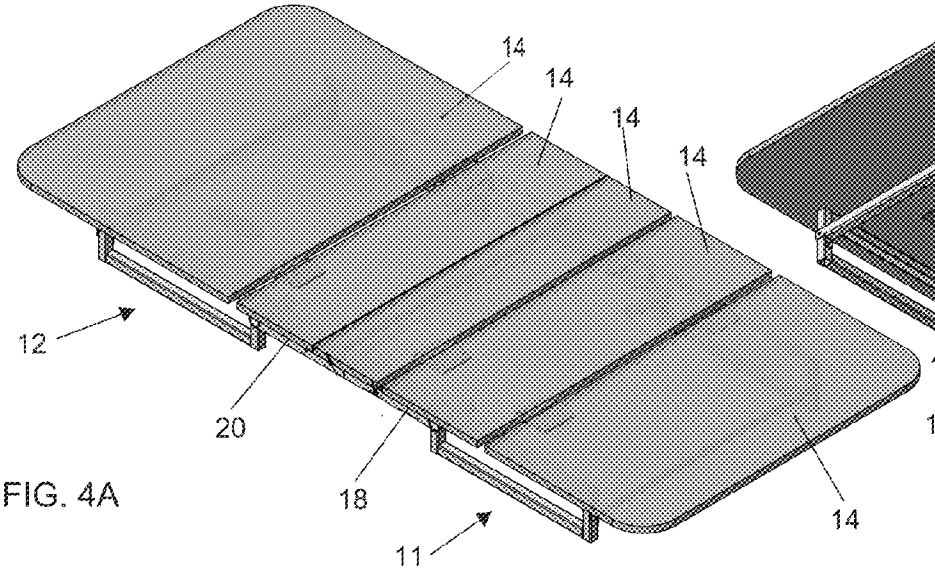
FIG. 4*a* is an isomeric top view of a bed according to an embodiment.
Figure 4C:
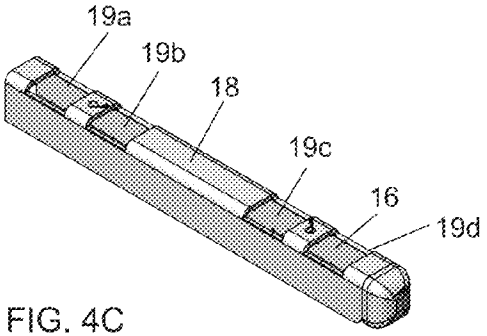
FIG. 4*c* is a close-up view of the inner tube and sleeve of FIG. 4*a* and FIG. 4*b*.

In accordance with another implementation of this disclosure, shown in FIGS. 4*a*-4*c*, base portion 1 with head section 11 and foot section 12 is shown with a plurality of base boards 14, which are sized and placed to allow base portion and its head section 11 and foot section 12 to move up and down in a the desired manner. Shown more clearly in FIG. 4*c*, head section 11 and foot section 12 are connected together by an inner tube 16 sliding into a sleeve 18. As illustrated, sleeve 18 has a plurality of notches 19 in the sidewall of sleeve 18 to provide greater dimensional control and flexibility when combining the head section 11 and foot section 12 together. Notches 19 are especially useful when putting together base portion 1 on an uneven floor. Notches 19 provide more freedom of movement of inner tube 16.

As in the previous implementation, inner tube 16 is constrained in its own sleeve 20. Sleeve 20 can also have notches 21 (shown in FIG. 4B) to allow sleeve 20 further freedom of movement.

According to these variations, and still others within the skill of a practitioner of the art of design of mechanical beds, and adjustable beds, and modular adjustable beds, the present invention should be considered in accordance with the following claims, only, and not solely in accordance with that particular embodiment within which the invention has been taught.

What is claimed is:

1. A frame for an adjustable bed comprising:

a first section having two longitudinal frame rails separated by at least two lateral members extending between the two longitudinal frame rails, and two sleeves each having a cavity and each sleeve having at least one notch in a sidewall of the sleeve;

a second section having two longitudinal frame rails separated by at least two lateral members extending between the two longitudinal frame rails, and two sleeves each having a cavity and each sleeve having at least one notch in a sidewall of the sleeve, and in each sleeve a floating inner tube, each floating inner tube is articulable in a transverse and lateral manner within both the sleeve of the second section and the sleeve of the first section with improved articulability provided by the at least one notch in each sleeve to guide each floating inner tube into the corresponding sleeve of the first section to combine the second section and the first section, and each floating inner tube is movable between a first position retracted in the cavity of each sleeve and a second position extending from the cavity of each sleeve; and wherein the second section is selectively combined with the first section with a portion of each inner tube on the longitudinal frame rails of the second section positioned in each sleeve of the longitudinal frame rails of the first section to selectively combine the first section and the second section.

2. The frame of claim 1, wherein each inner tube further comprises a first spring pin, and wherein each of the two sleeves on the longitudinal frame rails of the first section have a hole, and wherein the first spring pin of each inner tube selectively engages the hole to selectively hold each inner tube in the second position extending from the cavity of the sleeve.

3. The frame of claim 2, wherein each inner tube further comprises a second spring pin, and wherein each of the two sleeves on the longitudinal frame rails of the second section have a hole, and wherein the first spring pin of each inner tube selectively engages the hole of the sleeve on the longitudinal frame rail of the first section to combine each inner tube with the first section and simultaneously the second spring pin of each inner tube engages the hole in the sleeve on the longitudinal frame rail of the second section to hold each inner tube in the second position extending from the cavity of the sleeve so that each inner tube simultaneously combines the first section and the second section.

4. The frame of claim 3, wherein the first spring pin on each inner tube is bulbous-nose in shape and extends under spring force transversely to each inner tube in a region of each inner tube that is inserted into the sleeve on the longitudinal frame rail of the second section, and wherein the second spring pin on each inner tube is bulbous-nose in shape and extends under spring force transversely to each inner tube in a region of each inner tube that is inserted into the sleeve on the longitudinal frame rail of the second section.

5. The frame of claim 4, wherein the second section with each inner tube in the first position is sufficiently small as to fit upon a standard shipping pallet of 48" by 48".

6. The frame of claim 5, wherein the first section is combined to the second section without the use of tools.

7. The frame of claim 1, wherein each floating inner tube is a steel square tube with a square cross section and a plastic nose having a sloping profile and a rounded cross-section.

8. The frame of 7, wherein each floating inner tube further comprises a first spring pin, and wherein each of the two sleeves on the longitudinal frame rails of the first section further comprises a hole, and wherein the first spring pin of each floating inner tube selectively engages the hole of the sleeve on the longitudinal frame rail of the first section to combine each floating inner tube with the first section to hold each floating inner tube in the second position extending from the cavity of the sleeve and combined to the second section.

9. The frame of claim 8, wherein each floating inner tube further comprises a first spring pin, and wherein the two sleeves on the longitudinal frame rails of the second section further comprise a hole, and wherein the second spring pin of each floating inner tube selectively engages the hole of the sleeve on the longitudinal frame rail of the second section to combine each floating inner tube with the longitudinal frame rail to hold each floating inner tube in the first position retracted in the cavity of the sleeve.

10. The frame of claim 1, wherein the second section is a foot section and the first section is a head section.

* * * * *